US010027014B2

(12) United States Patent
Kim et al.

(10) Patent No.: US 10,027,014 B2
(45) Date of Patent: Jul. 17, 2018

(54) ANTENNA APPARATUS AND VEHICLE USING THE SAME

(71) Applicant: HYUNDAI MOTOR COMPANY, Seoul (KR)

(72) Inventors: Yong Ho Kim, Gunpo-si (KR); Hyeon Je Son, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/949,115

(22) Filed: Nov. 23, 2015

(65) Prior Publication Data

US 2017/0069950 A1 Mar. 9, 2017

(30) Foreign Application Priority Data

Sep. 9, 2015 (KR) ..... 10-2015-0127396

(51) Int. Cl.

| | |
|---|---|
| ***H01Q 1/12*** | (2006.01) |
| ***H01Q 9/04*** | (2006.01) |
| ***H01Q 3/02*** | (2006.01) |
| ***H01Q 19/10*** | (2006.01) |
| ***H01Q 1/32*** | (2006.01) |

(52) U.S. Cl.

CPC ..... *H01Q 1/125* (2013.01); *H01Q 1/32* (2013.01); *H01Q 3/02* (2013.01); *H01Q 9/04* (2013.01); *H01Q 19/10* (2013.01)

(58) Field of Classification Search

CPC ..... H01Q 1/125; H01Q 3/2623; H01Q 21/06; H01Q 21/061; H01Q 21/062; H01Q 21/064; H01Q 21/065; H01Q 21/067; H01Q 21/068; H01Q 21/29; H01Q 21/293

See application file for complete search history.

(56) References Cited

U.S. PATENT DOCUMENTS

| | | | | | |
|---|---|---|---|---|---|
| 5,420,598 | A * | 5/1995 | Uematsu | H01Q 1/3275 | 343/765 |
| 5,617,103 | A * | 4/1997 | Koscica | H01Q 3/36 | 333/161 |
| 5,678,171 | A * | 10/1997 | Toyama | H01Q 1/28 | 342/359 |
| 2005/0248496 | A1* | 11/2005 | Chen | H01Q 1/1228 | 343/766 |
| 2007/0013593 | A1* | 1/2007 | Zafar | H01Q 1/3275 | 343/713 |

(Continued)

FOREIGN PATENT DOCUMENTS

| | | |
|---|---|---|
| JP | 2007-142988 A | 6/2007 |
| JP | 2008-098853 A | 4/2008 |

(Continued)

OTHER PUBLICATIONS

Korean Office Action issued in Application No. 10-2015-0127396 dated May 18, 2016.

*Primary Examiner* — Daniel J Munoz

(74) *Attorney, Agent, or Firm* — McDermott Will & Emery LLP

(57) ABSTRACT

An antenna apparatus includes a first antenna unit inclined at a first inclination angle, a second antenna unit inclined in a direction opposite to the first antenna unit at a second inclination angle. A distribution unit distributes an electrical signal to one of the first antenna unit and the second antenna unit.

24 Claims, 21 Drawing Sheets

(56) References Cited

U.S. PATENT DOCUMENTS

| | | | | |
|---|---|---|---|---|
| 2007/0188386 | A1* | 8/2007 | Cheng | H01Q 9/40 343/700 MS |
| 2007/0279310 | A1* | 12/2007 | Tsai | H01Q 1/1207 343/795 |
| 2008/0272973 | A1 | 11/2008 | Stutzke | |

FOREIGN PATENT DOCUMENTS

| | | | |
|---|---|---|---|
| JP | 2010-200160 | A | 9/2010 |
| KR | 10-1992-0009219 | B | 10/1992 |
| KR | 10-2005-0118348 | A | 12/2005 |
| KR | 10-2006-0048432 | A | 5/2006 |
| KR | 10-2010-0022759 | A | 3/2010 |

* cited by examiner

ANTENNA APPARATUS AND VEHICLE USING THE SAME

CROSS-REFERENCE TO RELATED APPLICATION

This application claims the benefit of priority to Korean Patent Application No. 10-2015-0127396, filed on Sep. 9, 2015 in the Korean Intellectual Property Office, the disclosure of which is incorporated herein by reference.

TECHNICAL FIELD

The present disclosure relates to an antenna apparatus and a vehicle using the antenna apparatus.

BACKGROUND

A vehicle is a means to transport an object such as a person or luggage to a destination. In general, the vehicle moves on a road or railroad by at least one wheel generally installed on the vehicle to transport the object. The above-described vehicle may include, for example, a three-wheeled or four-wheeled vehicle, a two-wheeled vehicle such as a motor cycle, a construction machine, a bicycle, a train which runs on a rail of a railway, etc.

Various convenience devices for a driver or a passenger may be provided inside the vehicle. For example, a display for providing various information to a driver or fellow passengers may be provided inside the vehicle. In addition, controllers which control the convenience devices may be provided inside the vehicle. Such a display or controllers for the vehicle may use a variety of information received from outside of the vehicle to provide a variety of features, and an antenna apparatus for receiving the various information may be provided on the vehicle.

SUMMARY

An aspect of the present inventive concept provides an antenna apparatus which allows radiation energy output from the antenna apparatus to outside to concentrate in a desired direction, in addition, a phenomenon in which radiation energy of the antenna apparatus according to effects of external objects is reduced to be minimized, and a possible communication range to be expended.

Another aspect of the present inventive concept provides an antenna apparatus which prevents an effective communication distance from being reduced and prevents communication failure from occurring caused by antenna energy not being concentrated on another vehicle or an external infrastructure when a communication between a vehicle to another vehicle or a vehicle to the infrastructure, caused by occurring of an eccentricity of antenna beam due to a metal frame forming a vehicle exterior, and a vehicle using the antenna apparatus.

Additional aspects of the invention will be set forth in part in the description which follows and, in part, will be obvious from the description, or may be learned by practice of the invention.

In accordance with one exemplary of the present inventive concept, an antenna apparatus includes a first antenna unit inclined at a first inclination angle, a second antenna unit inclined in a direction opposite to the first antenna unit at a second inclination angle, and a distribution unit distributing an electrical signal to one of the first antenna unit and the second antenna unit.

At least one of the first inclination angle and the second inclination angle may be adjustable.

The first antenna unit and the second antenna unit may be disposed in alternate directions on the substrate.

The first antenna unit may include a first antenna radiation unit which radiates or receives an electromagnetic wave, and a first reflection unit which has one surface facing the first antenna radiation unit and provides directivity to the electromagnetic wave radiated from the first antenna radiation unit.

The antenna apparatus may further include a substrate on which the first antenna unit is inclined in a direction of one boundary thereof and the second antenna unit is inclined in a direction of another boundary. A first support has one end installed on the first reflection unit and another end installed on the substrate The antenna apparatus may further include a first rotation shaft member provided between the first support and the first reflection unit. The first reflection unit may rotate by the first rotation shaft member to change the first inclination angle.

The antenna apparatus may further include a second rotation shaft member provided between the first support and the substrate. The support may rotate by the second rotation shaft member to change the first inclination angle.

The first antenna unit further may include a first antenna radiation unit feed portion which transmits the electrical signal to the first antenna radiation unit.

The distribution unit may include a first antenna connection portion electrically connected to the first antenna unit, and a second antenna connection portion electrically connected to the second antenna unit.

The first antenna connection portion may include a first antenna connection portion end, and a first quarter-wave transformer ($\lambda/4$) electrically connected to the first antenna connection portion end.

The distribution unit may include a transmission path which transmits the electrical signal to the first antenna connection portion and the second antenna connection portion.

The transmission path may include a first transmission path connected to one end of the first antenna connection portion and one end of the second antenna connection portion. A second transmission path, which intersects and is connected to the first transmission path, transmits the electrical signal to the first transmission path. The electrical signal transmitted through the second transmission path may be branched when transmitted to the first transmission path.

The antenna apparatus may further include an external transmission cable electrically connected to the second transmission path.

In accordance with one exemplary embodiment of the present inventive concept, a vehicle includes a processor configured to output an electrical signal or to generate a control signal based on an electrical signal transmitted from the outside. An antenna apparatus converts the electrical signal output from the processor to an electromagnetic wave and radiates the electromagnetic wave, or converts the electromagnetic wave transmitted from the outside to the electrical signal and transmits the electrical signal to the processor. The antenna apparatus includes a substrate, a first antenna unit installed on the substrate to be inclined in a direction of one boundary of the substrate at a first inclination angle, a second antenna unit installed on the substrate to be inclined in a direction of another boundary of the substrate at a second inclination angle. A distribution unit distributes the electrical signal to one of the first antenna unit and the second antenna unit.

At least one of the first inclination angle and the second inclination angle may be adjustable.

The first antenna unit and the second antenna unit may be disposed in alternate directions on the substrate.

The first antenna unit may include a first antenna radiation unit which radiates or receives the electromagnetic wave, and a first reflection unit which has one surface facing the first antenna radiation unit and provides directivity to the electromagnetic wave radiated from the first antenna radiation unit.

The distribution unit may include a first antenna connection portion electrically connected to the first antenna unit, and a second antenna connection portion electrically connected to the second antenna unit.

The first antenna connection portion may include a first antenna connection portion end, and a first quarter-wave transformer ($\lambda/4$) electrically connected to the first antenna connection portion end.

The distribution unit may include a transmission path which transmits the electrical signal to the first antenna connection portion and the second antenna connection portion.

The transmission path may include a first transmission path connected to one end of the first antenna connection portion and one end of the second antenna connection portion. A second transmission path, which intersects and is connected to the first transmission path, transmits the electrical signal to the first transmission path. The electrical signal transmitted through the second transmission path may be branched when transmitted to the first transmission path.

The antenna apparatus may be installed between an engine room and a dashboard of the vehicle.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
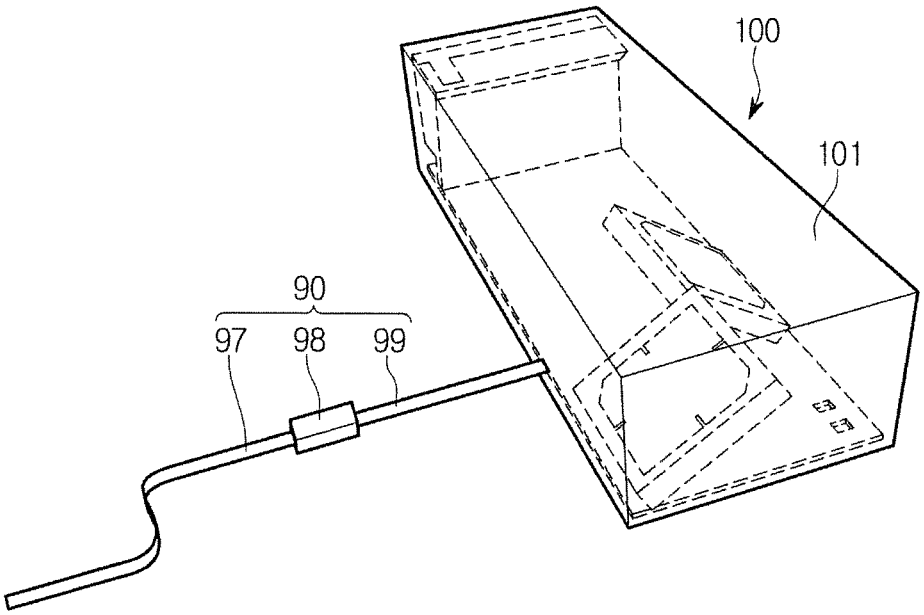
FIG. 1 is a view illustrating an exterior of an antenna apparatus according to one embodiment in the present disclosure.

Reference will now be made in detail to exemplary embodiments, examples of which are illustrated in the accompanying drawings, wherein like reference numerals refer to like elements throughout.

Hereinafter, one embodiment of an antenna apparatus will be described in accordance with FIGS. 1 to 13. In following descriptions, a designer will denote an individual or a group who performs a design and manufacturing of an antenna apparatus, and a user will denote an individual or a group who uses the antenna apparatus. In addition, a size of an angle which will be described here will be expressed using a hexadecimal method.

FIG. 1 is a view illustrating an exterior of an antenna apparatus according to one embodiment in the present disclosure.

As illustrated in FIG. 1, an antenna apparatus 100 may include an external housing 101 forming an exterior of the antenna apparatus 100 and various components installed in the external housing 101.

The external housing 101 may have various components needed for an operation of the antenna apparatus 100 embedded, fix the embedded components stably, and safely protect the embedded components from an outside impact. The external housing 101 may have various shapes according to designer's choice, for example, the external housing 101 may have a hexahedron shape as illustrated in FIG. 1. In addition, the external housing 101 may have various shapes according to installation positions or shapes of embedded components of the antenna apparatus 100 such as a shape of a shark's dorsal fin.

The external housing 101 may be formed using a material through which electromagnetic waves radiated by a first antenna unit (110 of FIG. 2) and a second antenna unit (120 of FIG. 2) provided in the external housing 101 may easily penetrate and be radiated. For example, the external housing 101 may be implemented using a material such as a combinational resin or glass.

An external transmission cable 90 which supplies an electrical signal to components provided in the external housing 101 is provided in the external housing 101.

The external transmission cable 90 may include a first external transmission cable 97, a transmission cable connector 98 electrically connected to the first external transmission cable 97, and a second external transmission cable 99 which electrically connects the transmission cable connector 98 and the antenna apparatus 100.

The first external transmission cable 97 has one end connect to the transmission cable connector 98, and another end connect to at least one component provided separately from the antenna apparatus 100 such as a processor (not shown). The first external transmission cable 97 may transmit an electrical signal output from the at least one component to the antenna apparatus 100, or may transmit an electrical signal output from the antenna apparatus 100 to the at least one component.

The first external transmission cable 97 may be implemented using a cable which is formed of a conductive material such as copper, aluminum, a copper alloy, or an aluminum alloy. For example, the first external transmission cable 97 may use a general antenna connection cable such as a radio frequency (RF) cable.

The transmission cable connector 98 is provided to electrically connect the first external transmission cable 97 and the second external transmission cable 99.

The transmission cable connector 98 may include two corresponding connectors capable of coupling to or decoupling from each other, one of the two connectors is provided at one end of the first external transmission cable 97, the other thereof is provided at one end of the second external transmission cable 99. The transmission cable connector 98 may connect or disconnect the first external transmission cable 97 to or from the second external transmission cable 99.

The transmission cable connector 98 may be implemented using various kinds of connectors. For example, the transmission cable connector 98 may be implemented using at least one among a subminiature version A (SMA) connector, a subminiature version B (SMB) connector, a subminiature version C (SMC) connector, a micro coaxial (MCX) connector, a micro-miniature coaxial (MMCX) connector, a threaded Neill-Concelman (TNC) connector, a Bayonet Neill-Concelman (BNC) connector, and a Fakra connector.

The second external transmission cable 99 may have one end connected to the transmission cable connector 98 and the other end connected to the antenna apparatus 100, and may transmit an electrical signal transmitted through the first external transmission cable 97 to the antenna apparatus 100 or may transmit an electrical signal output by the antenna apparatus 100 through the transmission cable connector 98 to the first external transmission cable 97. The second external transmission cable 99 is connected to the external housing 101 and an internal component, for example, a substrate (150 of FIG. 2), and more specifically, to be directly or indirectly connected to a transmission path 133 installed at a substrate 150.

The second external transmission cable 99 may be implemented using a conductive cable such as copper, aluminum, or an aluminum alloy. For example, the second external transmission cable 99 may be implemented using an antenna connection cable which is generally used such as an RF cable.

Hereinafter, the various components installed in the external housing 101 of the antenna apparatus 100 will be described.

Figure 2:
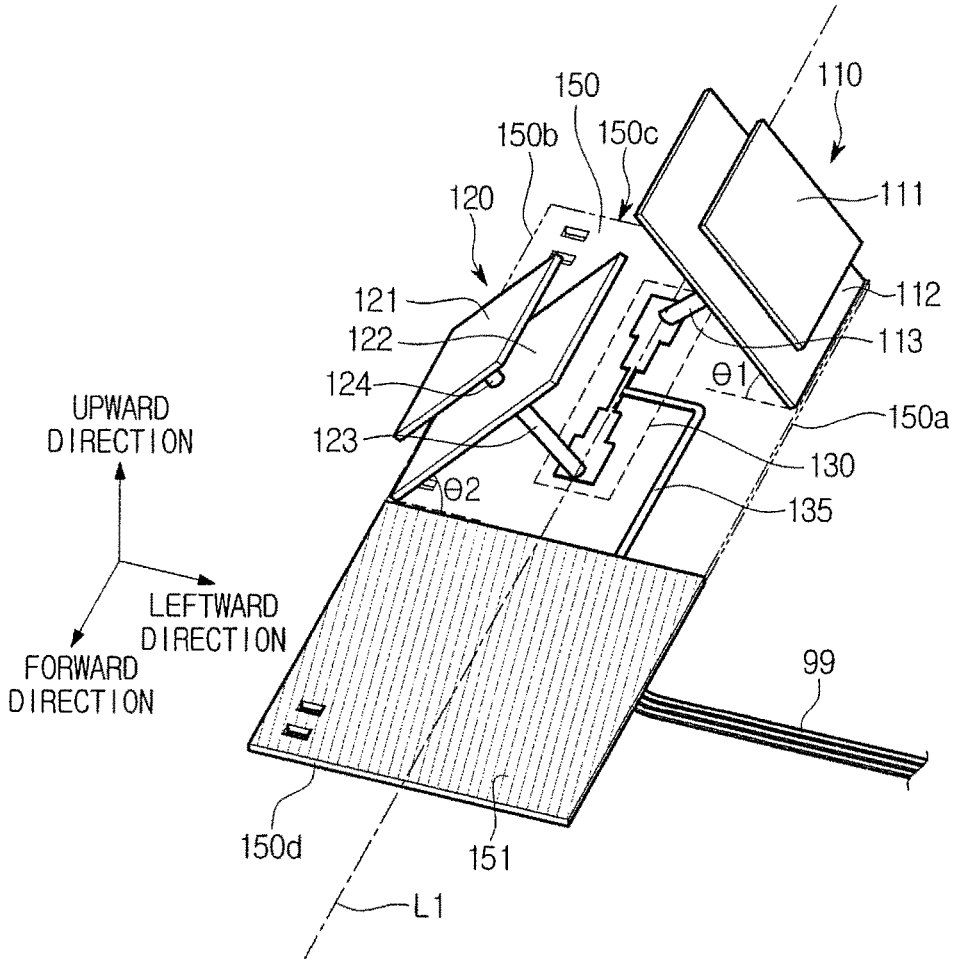
FIG. 2 is a perspective view illustrating an internal structure of the antenna apparatus according to one embodiment in the present disclosure.
Figure 3:
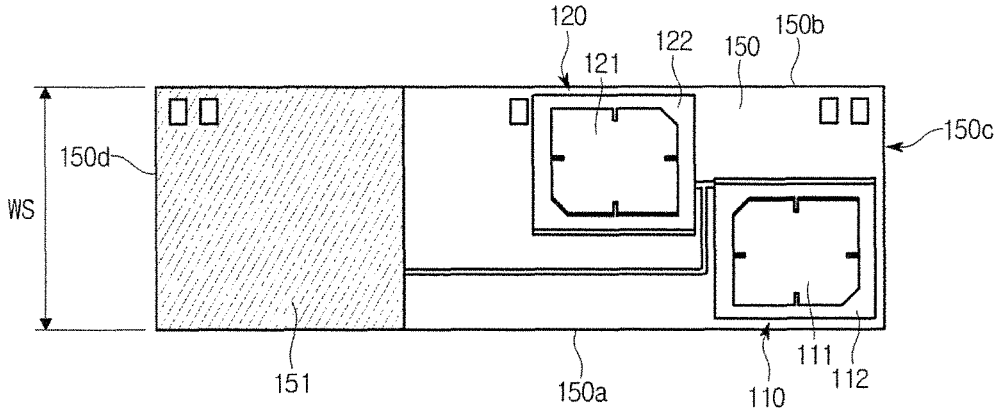
FIG. 3 is a plan view illustrating the internal structure of the antenna apparatus according to one embodiment in the present disclosure.
Figure 4:
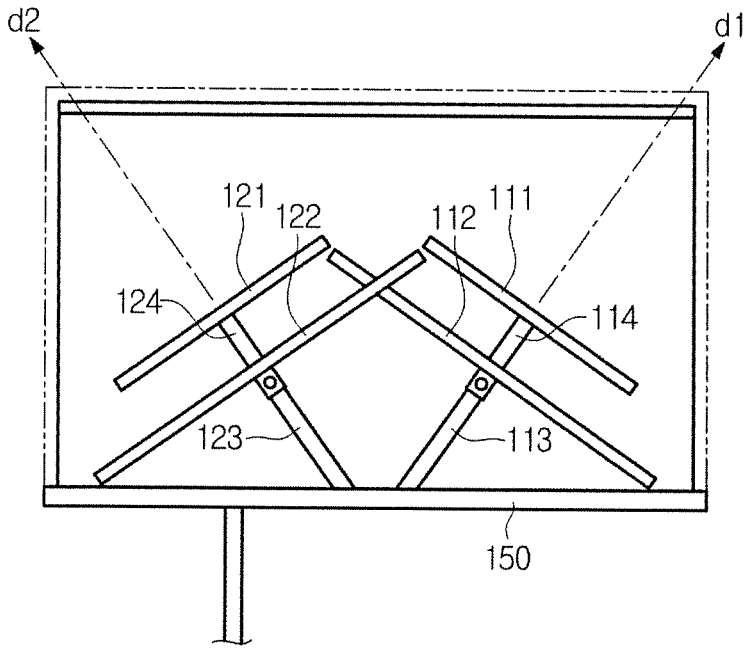
FIG. 4 is a front view illustrating the internal structure of the antenna apparatus according to one embodiment in the present disclosure.

FIG. 2 is a perspective view illustrating an internal structure of the antenna apparatus according to one embodiment in the present disclosure, FIG. 3 is a plan view illustrating the internal structure of the antenna apparatus according to one embodiment in the present disclosure, and FIG. 4 is a front view illustrating the internal structure of the antenna apparatus according to one embodiment in the present disclosure. Hereinafter, a direction at which ground 151 is formed is referred to as a forward direction, and a direction at which a first antenna unit 110 and a second antenna unit 120 are formed is referred to as a backward direction, on the substrate 150 in FIG. 2.

In addition, a direction in which a surface of the substrate 150 on which the first antenna unit 110 and the second antenna unit 120 are formed faces is referred to as an upward direction, and the opposite direction thereof is referred to as a downward direction. One surface facing in the upward direction is referred to as an upper surface. In addition, when the forward direction is referred to as a twelve o'clock direction, a nine o'clock direction is referred to as a leftward direction and a three o'clock direction is referred to as a rightward direction.

Referring to FIGS. 2 to 4, the antenna apparatus 100 may include the first antenna unit 110, the second antenna unit 120, a distribution unit 130, and the substrate 150.

The first antenna unit 110 may radiate an electromagnetic wave in a predetermined direction d1, and the second antenna unit 120 may be provided to radiate an electromagnetic wave in a direction d2 different from the electromagnetic wave radiated by the first antenna unit 110. The first antenna unit 110 and the second antenna unit 120 are installed on the same surface of the substrate 150 and face in different directions.

The first antenna unit 110 may radiate a first electromagnetic wave corresponding to an electrical signal transmitted to the first antenna unit 110 in the first direction d1. The first antenna unit 110 may be electrically connected to a first antenna connection portion 131 in the distribution unit 130, receive the electrical signal transmitted through the first antenna connection portion 131, generate a corresponding electromagnetic wave based on the received electrical signal, and radiate the electromagnetic wave in the air.

The first antenna unit 110 may be implemented using a monopole antenna, a dipole antenna, a patch antenna, or an antenna in which a plurality of antennas are arranged, and here, the patch antenna may include a micro-strip patch antenna or a printed antenna.

The first antenna unit 110 according to one embodiment may be installed on an upper surface of the substrate 150 to be inclined at a predetermined angle θ1 (hereinafter, referred to as a first inclination angle) in a direction of one boundary 150*a* of the substrate 150. Accordingly, a first antenna radiation unit 111 of the first antenna unit 110 is provided to face in an upper-leftward direction with respect to the substrate 150.

Here, the first inclination angle θ1 may include an arbitrary angle in a range of 0° to 90°, and more specifically, may include an arbitrary angle selected by a designer or a user in a range of 20° to 70°. The first inclination angle θ1 may also be changed according to a choice of the designer or the user. The first inclination angle θ1 of the first antenna unit 110 according to one embodiment may also be variously changed according to a control of the user. The description thereof will be described below.

The second antenna unit 120 may radiate a second electromagnetic wave corresponding to an electrical signal transmitted to the second antenna unit 120 in a second direction d2. The second antenna unit 120 may electrically connected to a second antenna connection portion 132 in the distribution unit 130, receive the electrical signal from the second antenna connection portion 132, generate an electromagnetic wave corresponding to the received electrical signal, and radiate the electromagnetic wave in the air.

The second antenna unit 120 may be implemented using a monopole antenna, a dipole antenna, a patch antenna, or an antenna in which a plurality of antennas are arranged. Here, the patch antenna may include a micro-strip patch antenna, a printed antenna, or the like.

The second antenna unit 120 according to one embodiment may be disposed on the upper surface of the substrate 150 to be inclined at a predetermined angled θ2 (hereinafter, referred to as a second inclination angle) in a direction of another boundary 150*b* of the substrate 150. Here, the other boundary 150*b* of the substrate 150 may be what faces the one boundary 150*a* of the substrate 150 positioned in a direction in which the first antenna unit 110 is inclined. In other words, the one boundary 150*a* and the other boundary 150*b* may respectively be a boundary positioned at a right end of the substrate 150 and a boundary positioned at a left end thereof. Accordingly, the second antenna unit 120 is inclined in a direction opposite to a direction in which the first antenna unit 110 is inclined, and thus faces in a direction different from the first antenna unit 110. Specifically, the second antenna unit 120 faces in an upper-rightward direction with respect to the substrate 150.

In other words, the first antenna unit 110 and the second antenna unit 120 may face in different directions, for example, respectively an upper-leftward direction and an upper-rightward direction. Thus, the first electromagnetic wave radiated by the first antenna unit 110 and the second electromagnetic wave radiated by the second antenna unit 120 proceed in different directions d1 and d2. An angle (180°−(θ1+θ2)) between a direction in which the first antenna unit 110 faces and a direction in which the second antenna unit 120 faces may include one value among values between 0° and 180°, and for example, may include 90° or an angle close thereto. The angle (180°−(θ1+θ2)) between the direction in which the first antenna unit 110 faces and the direction in which the second antenna unit 120 faces may be decided according to an arbitrary choice of a designer or a user. The angle (180°−(θ1+θ2)) between the direction in which the first antenna unit 110 faces and the direction in which the second antenna unit 120 faces may be adjusted by the designer or the user so that a radiation energy radiated by the antenna apparatus 100 has an optimum value to be properly concentrated thereon.

According to one embodiment, since the first antenna unit 110 is inclined in a direction of the one boundary 150*a* of the substrate 150, the first antenna unit 110 may be provided relatively closer to the left boundary 150*a* of the substrate 150 than the second antenna unit 120. On the contrary, since the second antenna unit 120 is inclined in a direction of the other boundary 150*b* of the substrate 150, the second antenna unit 120 may be provided relatively more adjacent to the right boundary 150*b* of the substrate 150 than the first antenna unit 110. In other words, referring to FIG. 3, the first antenna unit 110 may shifted in a leftward direction on the substrate 150, and the second antenna unit 110 may be provided shifted in a rightward direction on the substrate 150. However, even though the first antenna unit 110 and the second antenna unit 120 are shifted to the boundaries 150*a* and 150*b*, supports 113 and 123 of the antenna units 110 and 120 are not necessarily installed on the substrate 150 to be respectively shifted in the predetermined directions of the boundaries 150*a* and 150*b* of the substrate 150. The description thereof will be described below.

The first antenna unit 110 and the second antenna unit 120 may be disposed on the substrate 150 not to contact each other. In other words, an end of the first antenna radiation unit 111 or an end of a first reflection unit 112 of the first antenna unit 110, and an end of a second antenna radiation unit 121 or an end of a second reflection unit 122 of the second antenna unit 120 may be separately disposed at a certain distance.

The first antenna unit 110 and the second antenna unit 120 may also be disposed sequentially from the backward direction to the forward direction on the substrate 150. In other words, the first antenna unit 110 may be disposed relatively closer to a boundary 150*c* positioned in the backward direction on the substrate 150 than the second antenna unit 120, and the second antenna unit 120 may be disposed relatively more adjacent to a boundary 150*d* positioned in the forward direction on the substrate 150 than the first antenna unit 110. For example, as illustrated in FIGS. 2 and 3, the first antenna unit 110 may be disposed adjacent to the rear boundary 150*c*, the second antenna unit 120 may be disposed at a center or a position close to the center of the substrate 150.

When the first antenna unit 110 is disposed adjacent to the left boundary 150*a* of the substrate 150, the second antenna unit 120 is disposed adjacent to the right boundary 150*b*, the first antenna unit 110 is simultaneously disposed adjacent to the rear boundary 150*c*, and the second antenna unit 120 is disposed at the center or the position around the center of the substrate 150, the first antenna unit 110 and the second antenna unit 120 may be disposed in alternate directions as illustrated in FIGS. 2 and 3. In other words, the first antenna unit 110 and the second antenna unit 120 may be disposed in alternate directions. When the first antenna unit 110 and the second antenna unit 120 are disposed in a zig-zag pattern, since a width WS of the substrate 150 may be relatively decreased, miniaturization of the antenna apparatus 100 is possible.

Hereinafter, the first antenna unit 110 of the antenna units 110 and 120 will be described more specifically.

Figure 5:
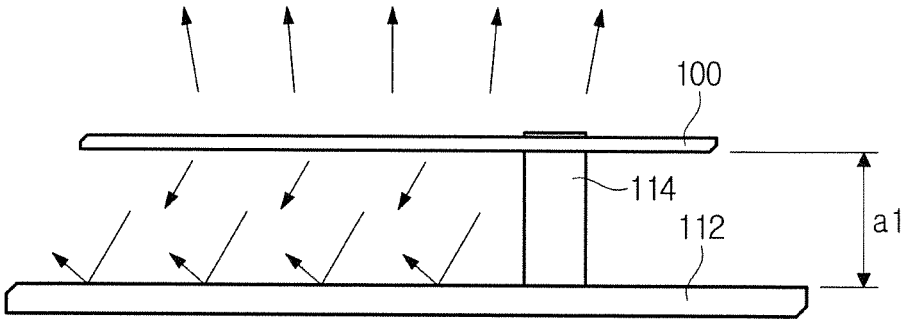
FIG. 5 is a side view illustrating an antenna unit according to one embodiment in the present disclosure.
Figure 6A:
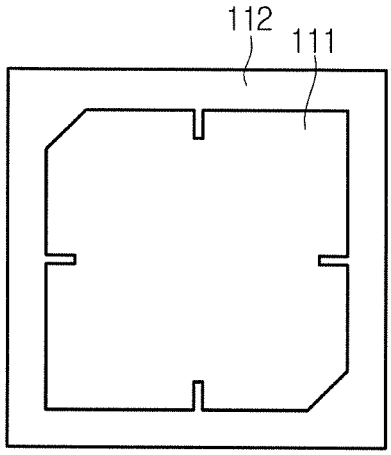
FIG. 6*a* is a plan view illustrating the antenna unit according to one embodiment in the present disclosure.
Figure 6B:
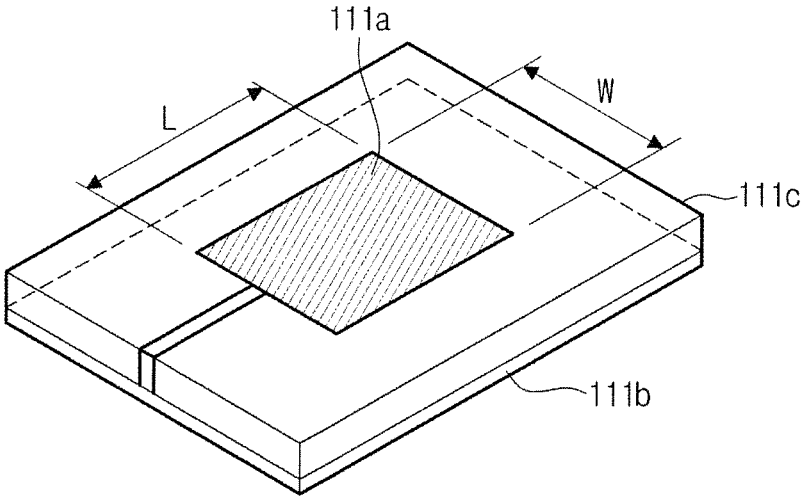
FIG. 6*b* is a view illustrating an example of an antenna radiation unit.

FIG. 5 is a side view illustrating an antenna unit according to one embodiment in the present disclosure, FIG. 6A is a plan view illustrating the antenna unit according to one embodiment in the present disclosure, and FIG. 6B is a view illustrating an example of an antenna radiation unit.

Referring to FIGS. 2 to 6A, the first antenna unit 110 may include the first antenna radiation unit 111, the first reflection unit 112, a first support 113, and a first antenna radiation unit feed portion 114.

The first antenna radiation unit 111 resonates according to a frequency of an electrical signal transmitted from the first antenna radiation unit feed portion 114, generates an electromagnetic wave corresponding to the electrical signal, and radiates the electromagnetic wave to the outside.

As illustrated in FIG. 6A, the first antenna radiation unit 111 may approximately have a rectangular shape when vertically seen, for example, the first antenna radiation unit 111 may have a square shape. However, the first antenna radiation unit 111 may not have a shape limited thereto, and may be implemented with various shapes according to a choice of a designer or a user. The first antenna radiation unit 111 may be relatively smaller than the first reflection unit 112 so an electromagnetic wave radiated toward the first reflection unit 112 among electromagnetic wave radiated by the first antenna radiation unit 111 may be more reflected.

The first antenna radiation unit 111 according to one embodiment illustrated in FIG. 6B may include a metal plate 111*a*, a ground portion 111*b*, and a dielectric 111*c* provided between the metal plate 111*a* and the ground portion 111*b* to resonate according to an applied electrical signal, and generate and radiate a corresponding electromagnetic wave. When an electrical signal is applied to the metal plate 111*a*, a resonance occurs between the metal plate 111*a* and the ground portion 111*b*, and thus, an electromagnetic wave corresponding to the applied electrical signal is generated and radiated to outside. Accordingly, the first antenna radiation unit 111 may radiate the electromagnetic wave corresponding to the electrical signal.

The antenna radiation unit 111 may include a plurality of metal plates 111*a*, and the metal plates 111*a* are arranged in a plurality of rows on the substrate, that is, the dielectric 111*c*.

The metal plate 111*a* may be implemented using copper, aluminum, or an alloy thereof. The metal plate 111*a* according to an embodiment may have a square, rectangular, rhombic, circular, or other various shapes when seen from above.

FIG. 6B is a view illustrating an example in which the metal plate 111*a* has a rectangular shape. In this case, each length of sides of the metal plate 111*a* of the first antenna radiation unit 111, that is, a width W and a height L, may be calculated by the following Equations 1 and 2.

$$W = \frac{c}{2f}\sqrt{\frac{2}{\varepsilon_r + 1}} \quad \text{[Equation 1]}$$

$$L = \frac{c}{2f\sqrt{\varepsilon_{eff}}} - 2\Delta L \quad \text{[Equation 2]}$$

In Equations 1 and 2, W denotes a width of the metal plate 111*a*, L denotes a height of the metal plate 111*a*, *c* denotes the speed of light, and f denotes a frequency. εr denotes a dielectric constant of the dielectric 111*c*, and when air is used as the dielectric 111*c*, εr may be given as 1.

εeff denotes an effective dielectric constant, and may be calculated using the following Equation 3.

$$e_{eff} = \frac{\varepsilon_r + 1}{2} + \frac{\varepsilon_r - 1}{2}\left[1 + \frac{12\ \mathrm{h}}{W}\right]^{-\frac{1}{2}} \quad \text{[Equation 3]}$$

Here, h denotes a height of the dielectric 111*c*, that is, a distance between the metal plate 111*a* and the ground portion 111*b*.

In addition, ΔL is calculated by the following Equation 4.

$$\Delta L = 0.412\frac{(\varepsilon_{eff} + 0.03)\left(\frac{W}{h} + 0.264\right)}{(\varepsilon_{eff} - 0.258)\left(\frac{W}{h} + 0.8\right)}h \quad \text{[Equation 4]}$$

When the above-described Equations 1 to 4 are used, the width W and the height L of the metal plate 111*a* may be obtained, and thus, the first antenna unit 110 may be designed.

As illustrated in FIG. 5, the first reflection unit 112 reflects an electromagnetic wave radiated in a direction of the first reflection unit among electromagnetic wave radiated by the first antenna radiation unit 111, and radiates the electromagnetic wave in a desired direction. In other words, the first reflection unit 112 provides directivity to the radiated electromagnetic wave. Accordingly, the electromagnetic wave radiated by the first antenna radiation unit 111 is radiated mostly in a specific direction.

The first reflection unit 112 may have one surface provided to face the first antenna radiation unit 111, and the other surface provided to face the substrate 150. The first support 113 is provided on the other surface of the first reflection unit 112, and physically connects the first antenna unit 110 and the substrate 150. The first support 113 may also be pivotable at the other surface of the first reflection unit 112, or fixed not to pivot.

The first reflection unit 112 may have a shape with a flat surface plate or a curved surface plate when seen from a side thereof, and have a rectangular or circular shape when seen from the front thereof. The first reflection unit 112 may be separated from the first antenna radiation unit 111 at a predetermined distance h, and a distance al between the first antenna radiation unit 111 and the second reflection unit 112 may be properly decided by a designer. The first antenna radiation unit feed portion 114 may be provided between the first antenna unit 110 and the first reflection unit 112. The first reflection unit 112 may also be omitted according to an embodiment.

The first antenna radiation unit feed portion 114 may apply an electrical signal transmitted from the distribution unit 130 to the first antenna radiation unit 111, and in addition, may support the first antenna radiation unit 111. The first antenna radiation unit feed portion 114 may be electrically connected to the distribution unit 130 through a circuit or a wire which passes through the first support 113 and the first reflection unit 112, and may apply the electrical signal transmitted from the distribution unit 130 to the first antenna radiation unit 111. Here, a metal circuit or a wire capable of transmitting an electrical signal may be provided at the first antenna radiation unit feed portion 114. Specifically, one end of the metal circuit or the wire of the first antenna radiation unit feed portion 114 may be electrically connected to a metal plate forming the first antenna radiation unit 111, and another end thereof may be electrically connected to the first antenna connection portion 131 of the distribution unit 130.

In addition, the first antenna radiation unit feed portion 114 may be provided between the first antenna radiation unit 111 and the first reflection unit 112 so that the first antenna radiation unit 111 is stably supported by the first reflection unit 112. For example, one end of the first antenna radiation unit feed portion 114 may couple to one surface of the first antenna radiation unit 111, and the other end thereof may couple to one surface of the first reflection unit 112.

The first antenna radiation unit feed portion 114 may have a pole shape which is manufacturable using a combinational resin or a metal having an inside or an outside provided with a metal circuit or a wire.

The first support 113 may support the first antenna unit 110. Specifically, the first support 113 may support all of the first antenna radiation unit 111, the first reflection unit 112, and the first antenna radiation unit feed portion 114. One end of the support 113 is attached to the other surface of the first antenna radiation unit 111 or the first reflection unit 112, and another end of the support 113 may be attached to the substrate 150. In this case, the other end of the first support 113 may be installed directly on the first antenna connection portion 131 of the distribution unit 130, as illustrated in FIG. 2.

The first support 113 may be installed on the substrate 150 to be inclined in a predetermined direction as illustrated in FIGS. 2 and 4. Specifically, the first support 113 may be inclined in a direction of the left boundary 150*a* of the substrate 150 at a predetermined angle (90°−θ1), and thus, the first antenna radiation unit 111 may be inclined at the first inclination angle θ1.

The first support 113 may have a pole shape which is manufacturable using a combinational resin or a metal having an inside or an outside provided with a metal circuit or a wire, and the metal circuit or the wire may be electrically connected to the distribution unit 130 and transmit an electrical signal transmitted through the distribution unit 130 to the first antenna radiation unit feed portion 114. Thus, the electrical signal may be transmitted to the first antenna radiation unit 111.

Hereinafter, various embodiments of the first antenna unit 110 capable of adjusting the first inclination angle θ1 will be described.

Figure 7:
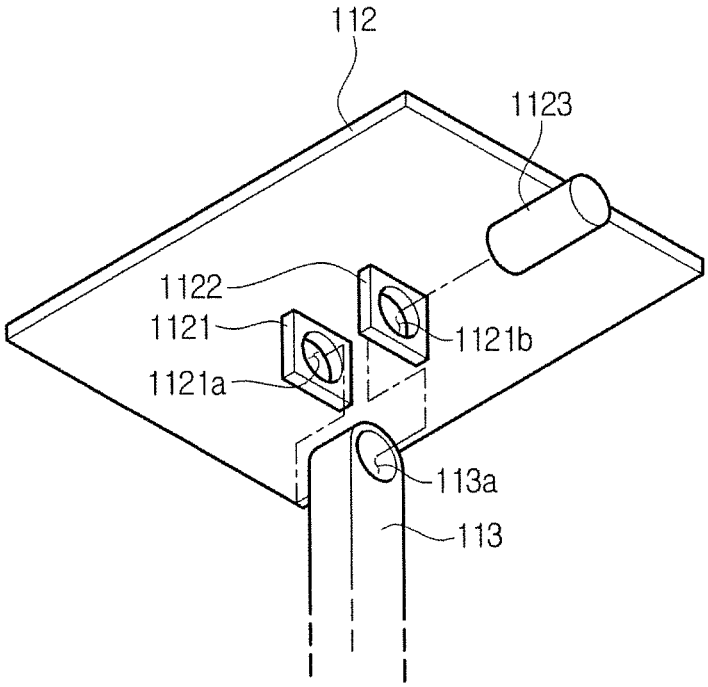
FIG. 7 is a view illustrating an example in which a rotation shaft member is installed at another surface of a reflection unit.

FIG. 7 is a view illustrating an example in which a rotating shaft member is installed at another surface of a reflection unit.

According to an embodiment illustrated in FIG. 7, the first reflection unit 112 may pivot with respect to the first support 113, and thus, the first inclination angle θ1 of the first antenna unit 110 may be adjusted. Specifically, the first antenna radiation unit 111, the reflection unit 112, and the first antenna radiation unit feed portion 114 are fixed to each other and do not pivot independently. Coupling units 1121 and 1122, to which the first support 113 is couplable, may protrude on the other surface of the first reflection unit 112. Insertion grooves 1121*a* and 1121*b* may be respectively provided in the coupling units 1121 and 1122.

In addition, a predetermined first groove 113*a* or a protrusion (not shown) may be provided in the one end of the support 113, the first groove 113*a* or the protrusion corresponds to the insertion grooves 1121*a* and 1121*b* of the coupling units 1121 and 1122. The other end of the first support 113 may be fixed to the substrate 150, for example, to a part of the distribution unit 130. When the insertion grooves 1121*a* and 1121*b* of the coupling units 1121 and 1122 and the first groove 113*a* are linearly disposed, a rotating shaft member 1123 may pass through and be inserted into the insertion grooves 1121*a* and 1121*b* of the coupling units 1121 and 1122, and the first groove 113*a*. The rotating shaft member 1123 may be implemented using a pin.

According to one embodiment, the rotating shaft member 1123 may be attached and fixed to the first groove 113*a* so that the first support 113 is rotatable according to a rotation of the rotating shaft member 1123. According to another embodiment, the rotating shaft member 1123 may be attached and fixed to the insertion grooves 1121*a* and 1121*b* so that the first reflection unit 112 is rotatable according to a rotation of the rotating shaft member 1123. A motor (not shown) configured to rotate the rotating shaft member 1123 may be further provided at one end or both ends of the rotating shaft member 1123, and the motor rotates the rotating shaft member 1123 according to a control signal transmitted from an external processor, and enables the first reflection unit 112 to relatively pivot with respect to the first support 113. The first antenna radiation unit 111 and the first antenna radiation unit feed portion 114 may correspondingly pivot together according to pivoting of the reflection unit 112, and thus, the first inclination angle θ1 of the first antenna unit 110 may be changed.

In the above description, one example in which the first reflection unit 112 and the first support 113 are pivotable with each other using the rotating shaft member 1123 was described, however, the first reflection unit 112 may be pivotable with each other using various tools and methods that a designer may take into account. For example, the first reflection unit 112 and the first support 113 may also be pivotable using a hinge or the like.

Figure 8:
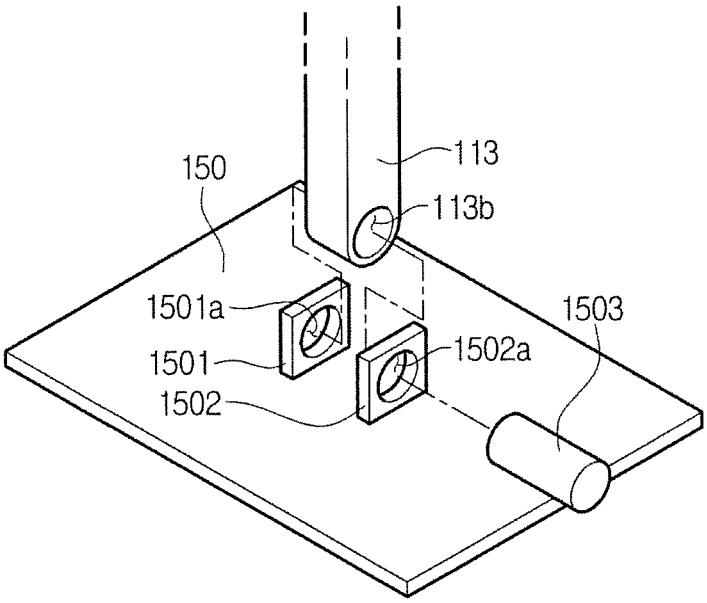
FIG. 8 is a view illustrating an example in which a rotation shaft member is installed at one surface of a substrate.

FIG. 8 is a view illustrating an example in which a rotating shaft member is installed at one surface of a substrate.

As illustrated in FIG. 8, the first support 113 may pivot with respect to the substrate 150, and thus, the first inclination angle θ1 of the first antenna unit 110 may be adjusted. Specifically, the one end of the first support 113 is fixed to the other surface of the first reflection unit 112, and a predetermined second groove 113*b* or a protrusion (not shown) may be provided at the other end thereof. In this case, the first antenna radiation unit 111, the reflection unit 112, and the first antenna radiation unit feed portion 114 are provided not to independently pivot with each other. Coupling units 1501 and 1502 may be provided on the substrate 150, and the coupling units 1501 and 1502, for example, may protrude from the upper surface of the substrate 150 or to be recessed in the substrate 150 as illustrated in FIG. 8.

When the coupling units 1501 and 1502 protrude from the substrate 150, insertion grooves 1501*a* and 1502*a* are respectively provided in the coupling units 1501 and 1502. Each of the insertion grooves 1501*a* and 1502*a* correspond to the second groove 113*b* of the first support 113. When the insertion grooves 1501*a* and 1502*a* of the coupling units 1501 and 1502 and the second groove 113*b* are linearly disposed, a rotating shaft member 1503 may pass through and be inserted into the insertion grooves 1501*a* and 1502*a* of the coupling units 1501 and 1502, and the second groove 113*b*.

According to one embodiment, the rotating shaft member 1503 may be attached and fixed to the second groove 113*b*, and thus, the first support 113 may be pivotable according to a rotation of the rotation shaft member 1503. A motor (not shown) configured to rotate the rotating shaft member 1503 may be further provided at one end or both ends of the rotating shaft member 1503. The motor may rotate the rotating shaft member 1503 according to a control signal transmitted from a processor or the like, and enable the first support 113 to pivot automatically. In this case, the first antenna radiation unit 111, the reflection unit 112, and the first antenna radiation unit feed portion 114 may pivot together correspondingly to the pivot of the first support 113. Thus, the first inclination angle θ1 of the first antenna unit 110 may be changed. The rotating shaft member 1123 may be implemented using a pin.

Figure 9A:
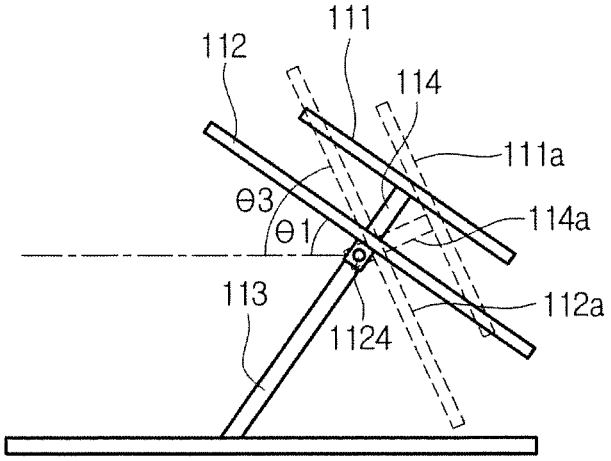
FIG. 9*a* is a view for describing an example of rotation of the antenna unit.
Figure 9B:
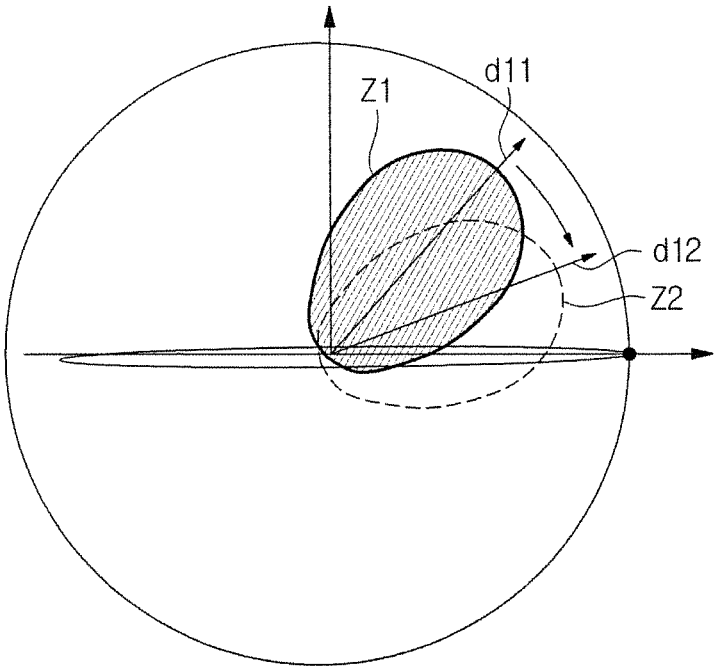
FIG. 9*b* is a view for describing a change of a direction of radiation energy according to the rotation of the antenna unit.

FIG. 9A is a view for describing an example of a rotation of the antenna unit, and FIG. 9B is a view for describing a change of a direction of radiation energy according to the rotation of the antenna unit. Each axis of x, y, and z axes in FIG. 9B denotes an axis configured to represent each space using a predetermined coordinate. Here, a direction of the x axis denotes a leftward direction, a direction of the y axis denotes a backward direction, and a direction of the z axis denotes an upward direction.

As described above, when the first antenna unit 110 pivots according to the pivot of the first reflection unit 112 or the first support 113, the first inclination angle of the first antenna unit 110 may be changed from the first inclination angle θ1 to an angle θ3. A changed first inclination angle θ3 may include an arbitrary angle in a range of 0° to 90° which is selectable according to an operation of a designer or a user. A radiation direction of an electromagnetic wave may also be changed from a first direction d11 to a second direction d12 by corresponding to a change of the first inclination angle from θ1 to θ3. Accordingly, the first antenna unit 110 may selectively radiate the electromagnetic wave in various directions in a predetermined range. Here, adjustment of the radiation directions d11 and d12 of the electromagnetic wave using the first antenna unit 110 may be manually performed by the user directly pivoting the first reflection unit 112 or pivoting the first support 113, or may also be automatically performed by a motor which operates according to a control signal applied from the outside.

The second antenna unit 120 may also have a structure which may be the same as or correspond to the first antenna unit 110 described above. Specifically, the second antenna unit 120 may include the second antenna radiation unit 121, the second reflection unit 122, a second support 123, and a second antenna radiation unit feed portion 124.

The second antenna radiation unit 121 may resonate according to a frequency of an electrical signal transmitted from the second antenna radiation unit feed portion 124, generate an electromagnetic wave corresponding to the electrical signal, and radiate the electromagnetic wave to outside. The second antenna radiation unit 121 according to an embodiment may include a metal plate, a ground portion, and a dielectric, and when an electrical signal is applied to the metal plate, an electromagnetic wave may be generated and thereby radiated to the outside. Since the detail explanations about these have already been described, the detail descriptions thereof will be omitted.

The second reflection unit 122 may reflect an electromagnetic wave radiated in a second reflection unit direction d4 among electromagnetic wave radiated by the second antenna radiation unit 121, and radiate the electromagnetic wave in a desired direction d3. The second reflection unit 122 may have a shape of a flat plate or curved plate when seen from a side thereof, or may have a rectangular of a circular shape when seen from the front thereof.

The second antenna radiation unit feed portion 124 may apply an electrical signal transmitted from the distribution unit 130 to the second antenna radiation unit 121, and in addition, support the second antenna radiation unit 121.

The second support 123 may support the second antenna unit 120. The second support 123 may be pivotably connected to the other surface of the second reflection unit 122, or pivotably connected to the upper surface of the substrate 150. A second inclination angle θ2 of the second antenna unit 120 may be changed according to the pivot of the second reflection unit 122 or the second support 123. Accordingly, a radiation direction d2 of an electromagnetic wave of the second antenna unit 120 may be adjusted. Adjustment of the radiation direction d2 of the electromagnetic wave of the second antenna unit 120 may also be performed by a designer or a user. In this case, the adjustment of the radiation direction d2 of the electromagnetic wave using the second antenna unit 120 may also be performed according to a manual operation of a designer or a user, or may also be automatically performed according to a control signal applied from the outside.

The second support 123 may be installed on the substrate 150 to be inclined in a predetermined direction like the first support 113 as illustrated in FIGS. 2 and 4. Specifically, the second support 123 may be inclined in a direction of the right boundary 150*b* of the substrate 150 at a predetermined angle (90°−θ2). Accordingly, the second antenna radiation unit 121 is inclined at the second inclination angle θ2.

According to one embodiment, as illustrated in FIG. 2, the first support 113 and the second support 123 may be sequentially disposed in parallel on a line L1 which vertically passes through the boundary 150*c* positioned in the backward direction and one boundary 150*d* positioned in the forward direction, on the substrate 150.

In the above description, the second antenna radiation unit 121, the second reflection unit 122, the second support 123, and the second antenna radiation unit feed portion 124 have been described briefly. Since the second antenna radiation unit 121, the second reflection unit 122, the second support 123, and the second antenna radiation unit feed portion 124 respectively may be the same or perform the same functions as the first antenna radiation unit 111, the first reflection unit 112, the first support 113, and the first antenna radiation unit feed portion 114, the specific description thereof will be omitted here.

In addition, according to an embodiment, the second antenna radiation unit 121, the second reflection unit 122, the second support 123, and the second antenna radiation unit feed portion 124 may also be partially different from the above-described first antenna radiation unit 111, the first reflection unit 112, the first support 113, and the first antenna radiation unit feed portion 114. For example, a size of the metal plate 111*a* of the first antenna radiation unit 111 may be designed to be different from a size of the metal plate (not shown) of the second antenna radiation unit 121. The differentiation described above may be arbitrarily changed according to a choice of a designer.

Figure 10:
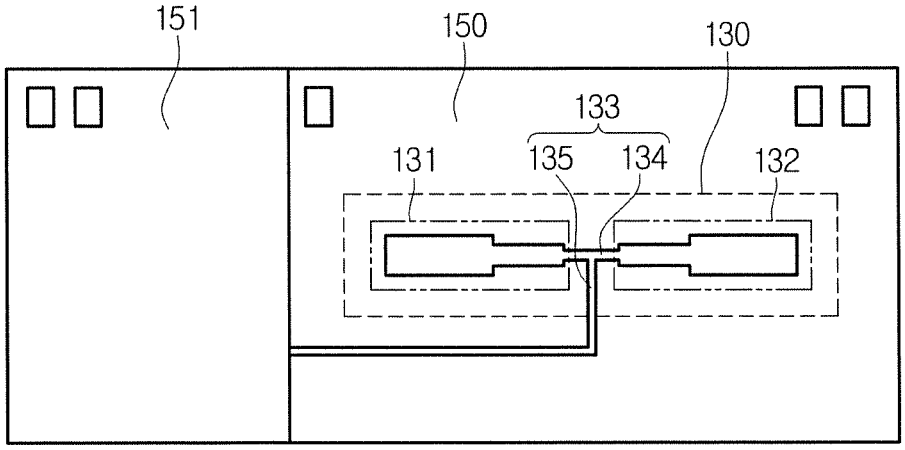
FIG. 10 is a view illustrating the substrate and a circuit installed thereon of the antenna apparatus.
Figure 11:
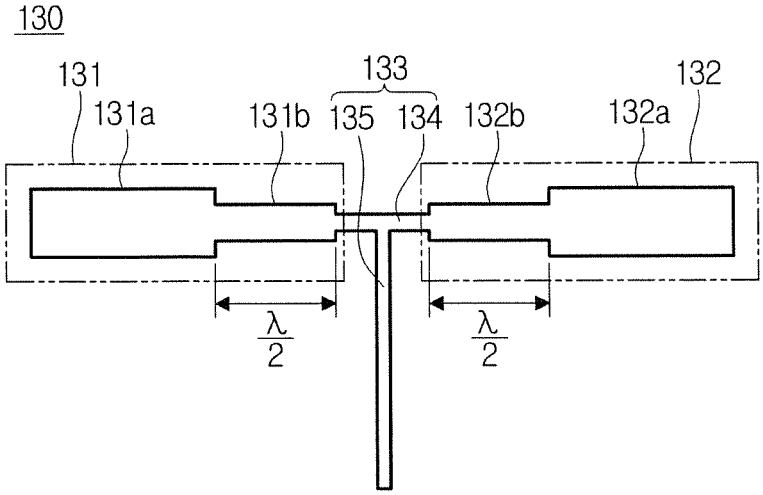
FIG. 11 is a view illustrating a distribution unit according to one embodiment in the present disclosure.

FIG. 10 is a view illustrating the substrate and a circuit installed thereon of the antenna apparatus, and FIG. 11 is a view illustrating a distribution unit according to one embodiment in the present disclosure.

As illustrated in FIG. 10, the distribution unit 130 is formed on the substrate 150. The distribution unit 130 may be implemented using a circuit or a metal wire.

The distribution unit 130 may distribute an electrical signal transmitted through the external transmission cable 90 to at least one of the first antenna unit 110 and the second antenna unit 120. The distribution unit 130 may be implemented using a RF power divider.

According to one embodiment, the distribution unit 130 may include the first antenna connection portion 131, the second antenna connection portion 132, and the transmission path 133.

The first antenna connection portion 131 may be electrically connected to the first antenna unit 110, and transmit an electrical signal transmitted through the transmission path 133 to the first antenna unit 110. The second antenna connection portion 132 may be electrically connected to the second antenna unit 120, and transmit an electrical signal transmitted through the transmission path 133 to the second antenna unit 120.

Referring to FIG. 11, the first antenna connection portion 131 may include a first connection portion end 131*a* and a first quarter-wave transformer 131*b* (λ/4 transformer).

The first connection portion end 131*a* is connected to a wire of a circuit provided at the first support 113. The first support 113 may also be physically installed at the first connection portion end 131*a*, and to this end, an installation surface on which the first support 113 is installable may be provided at the first connection portion end 131*a*. The installation surface may also have a shape with an installation groove recessed inside the substrate 150. As described above, the coupling units 1501 and 1502 may also be formed on the installation surface.

The first quarter-wave transformer 131*b* denotes a wire or a circuit having a length of % wavelength (λ/4) and a predetermined magnitude of impedance. The first quarter-wave transformer 131*b* may be provided at one end of the first connection portion end 131*a*, and may be electrically connected to the first connection portion end 131*a*. The first quarter-wave transformer 131*b* is provided between the first connection portion end 131*a* and the transmission path 133, specifically, a first transmission path 134, for impedance matching with the first antenna unit 110.

The first connection portion end 131*a* and the first quarter-wave transformer 131*b* may be implemented using a circuit or a wire, and according to an embodiment, may also be implemented using a strip-line. The strip-line denotes a microwave transmission line implemented using a conductive strip, a dielectric, and a conductive plate.

The second antenna connection portion 132 may include a second connection portion end 132*a* and a second quarter-wave transformer 132*b*.

The second connection portion end 132*a* is electrically connected to a wire or a circuit provided at the second support 123. The second support 123 may also be physically installed at the second connection portion end 132*a*. Here, an installation surface on which the second support 123 is installable may be provided at the second connection portion end 132*a*. The installation groove or the coupling units 1501 and 1502 may also be formed on the installation surface.

The second quarter-wave transformer 132*b* denotes a wire or a circuit having a length of ¼ wavelength (λ/4) and a predetermined magnitude of impedance, is provided at one end of the second connection portion end 132*a*, and is electrically connected to the second connection portion end 132*a*. The second quarter-wave transformer 132*b* is provided between the second connection portion end 132*a* and the transmission path 133, more specifically, the first transmission path 134 for impedance matching with the second antenna unit 120.

The second connection portion end 132*a* and the second quarter-wave transformer 132*b* may be implemented using a metal circuit or a wire, and may also be implemented using a strip-line.

The transmission path 133 may be electrically connected to the first antenna connection portion 131 and the second antenna connection portion 132, and transmit an electrical signal to the first antenna connection portion 131 and the second antenna connection portion 132. The transmission path 133 may be implemented using a metal circuit or wire formed on the substrate 150, and according to an embodiment, may also be implemented using a strip-line.

According to one embodiment, the transmission path 133 may include the first transmission path 134 and a second transmission path 135.

The first transmission path 134 is provided to have one end which is connected to one end of the first antenna connection portion 131 and the other end which is connected to one end of the second antenna connection portion 132. Specifically, the first transmission path 134 has the one end which is connected to one end of the first quarter-wave transformer 131*b*, and the other end which is connected to one end of the second quarter-wave transformer 132*b*. The first transmission path 134 is electrically connected to the second transmission path 135.

The second transmission path 135 has one end which is connected to the first transmission path 134. Here, the second transmission path 135 may also intersect the middle or near the middle of the first transmission path 134 and be connected to the first transmission path 134 as illustrated in FIG. 11. For example, the first transmission path 134 and the second transmission path 135 may intersect each other in a T shape. Accordingly, a path provided at the transmission path 133 is branched at a position at which the second transmission path 135 and the first transmission path 134 contact.

The other end of the second transmission path 135 may be directly or indirectly connected to the external transmission cable 90, specifically, the second external transmission cable 99. Accordingly the second transmission path 135 may be electrically connected to the external transmission cable 90, and may transmit an electrical signal transmitted through the external transmission cable 90 to the first transmission path 134.

When an electrical signal transmitted through the second transmission path 135 is transmitted to the first transmission path 134, the electrical signal is branched, accordingly, the transmitted electrical signal is transmitted to at least one of two paths provided at the first transmission path 134, those are, a path formed with a circuit or a wire positioned in a direction of the first antenna connection portion 131 and the other path formed with a circuit or a wire positioned in a direction of the second antenna connection portion 132. The electrical signal is finally transmitted to at least one of the first antenna connection portion 131 and the second antenna connection portion 132.

Accordingly, the electrical signal transmitted from the external transmission cable 90 may be transmitted to the at least one of the first antenna unit 110 and the second antenna unit 120, and at least one of the first antenna unit 110 and the second antenna unit 120 radiates at least one of the first electromagnetic wave and a second electromagnetic wave corresponding to the transmitted electrical signal.

The second transmission path 135 according to an embodiment may be formed on the substrate 150 in various patterns. For example, the second transmission path 135 may have a shape bent at least one time. A shape of the second transmission path 135 may be arbitrarily decided by a designer according to an arrangement shape of various components on the substrate 150.

The substrate 150 has an upper surface on which the first antenna unit 110, the second antenna unit 120, and the distribution unit 130 are formed. The first antenna unit 110, the second antenna unit 120, and the distribution unit 130 are provided on a part of the upper surface of the substrate 150, and the ground GND 151 is provided at another part thereof. In this case, one of the first antenna unit 110 and the second antenna unit 120 may be provided around the one rear boundary 150*c* of the substrate 150, and the ground 151 may be provided around the one front boundary 150*d* of the substrate 150.

In addition, the first antenna unit 110 may be disposed around the left boundary 150*a* of the substrate 150, and the second antenna unit 120 may be disposed around the right boundary 150*b* of the substrate 150. In this case, the first antenna unit 110 may be disposed adjacent to the rear boundary 150*c* of the substrate 150, and the second antenna unit 120 may be disposed relatively farther from the rear boundary 150*c* of the substrate 150 as described above. In this case, the first antenna unit 110 may be provided around a corner formed by the left boundary 150*a* and the rear boundary 150*c* of the substrate 150.

The substrate 150 may be implemented using a general printed circuit board (PCB). For example, the substrate 150 may also be implemented using a FR-4 board using a glass epoxy laminate.

Figure 12:
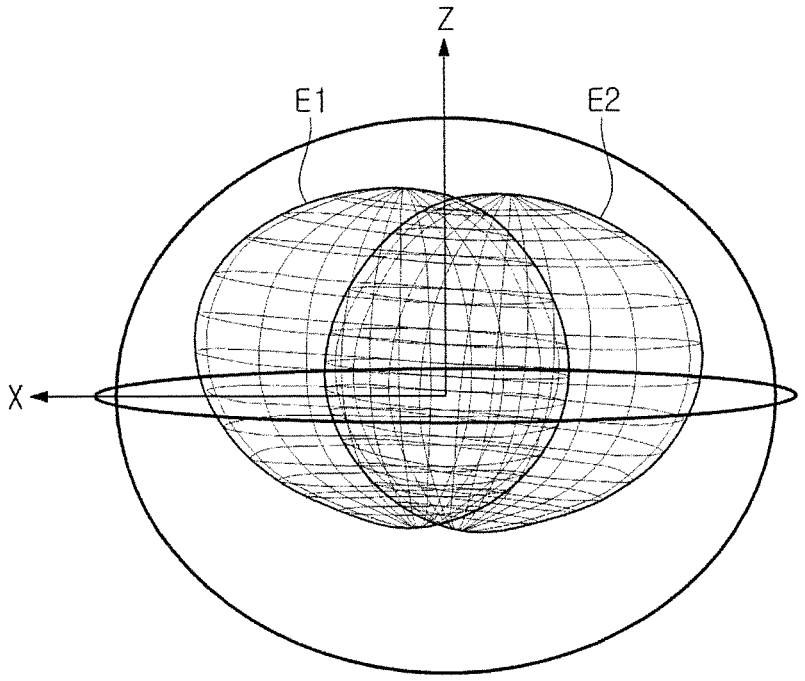
FIG. 12 is a view illustrating a combination of electromagnetic waves respectively radiated by a first antenna unit and a second antenna unit.
Figure 13:
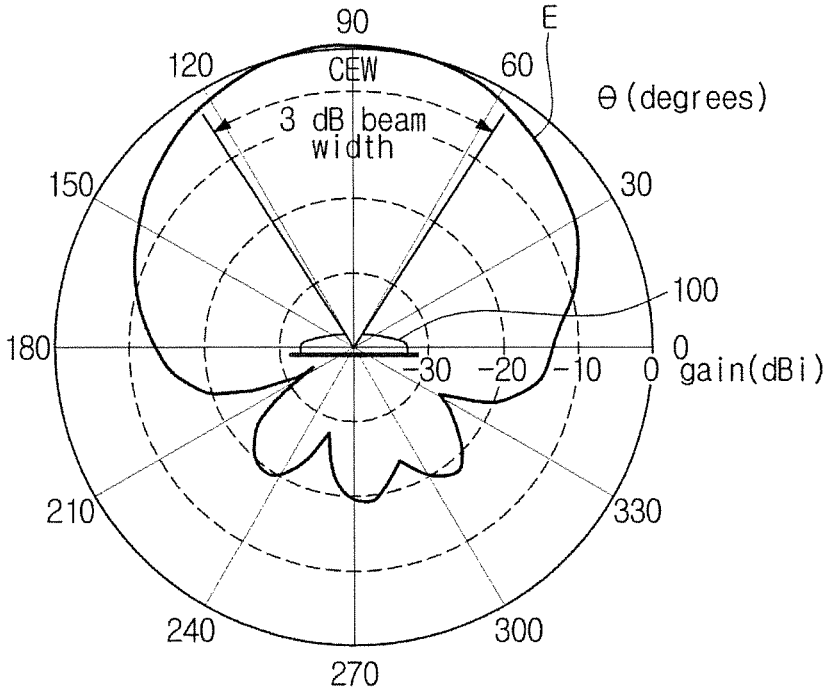
FIG. 13 is a view for describing a directivity of the radiation energy generated by the antenna apparatus.

FIG. 12 is a view illustrating a combination of electromagnetic waves respectively radiated by each of a first antenna unit and a second antenna unit, and FIG. 13 is a view for describing a directivity of the radiation energy generated by the antenna apparatus. In FIG. 12, an electromagnetic wave is on a coordinate system for representing positions. In FIG. 13, values of an external circumference denote angles, and lines which penetrate the center of a circle denote a magnitude of gain (dBi). Here, the magnitude of the gain increases away from the center of the circle, and the magnitude of the gain decreases toward the center of the circle.

When each of the first antenna unit 110 and the second antenna unit 120 radiates an electromagnetic wave, radiation patterns E1 and E2 of electromagnetic waves which face in different directions may be generated as illustrated in FIG. 12. A part of each of the radiation patterns E1 and E2 overlaps, and the other part thereof does not overlap. The antenna apparatus 100 has a radiation pattern E as illustrated in FIG. 13 due to the radiation patterns E1 and E2. Referring to FIG. 13, an electromagnetic wave radiated from the antenna apparatus 100 has a greatest gain in a direction range of 60° to 120° (channel estimation window (CEW)), and has a relatively lower gain in the other direction range. Accordingly, the electromagnetic wave is mostly radiated in a predetermined direction, for example, in the direction range of 60° to 120° (CEW), and radiation of the electromagnetic wave of the antenna apparatus 100 has directivity. Accordingly, since the electromagnetic wave is mostly radiated in a specific direction, radiation energy of an antenna may be concentrated in a desired direction, and thus, a reduction effect due to an external object, for example, a metallic exterior frame of a vehicle may be minimized.

Hereinafter, a vehicle in which the antenna apparatus is installed will be described in accordance with FIGS. 14 to 19.

Figure 14:
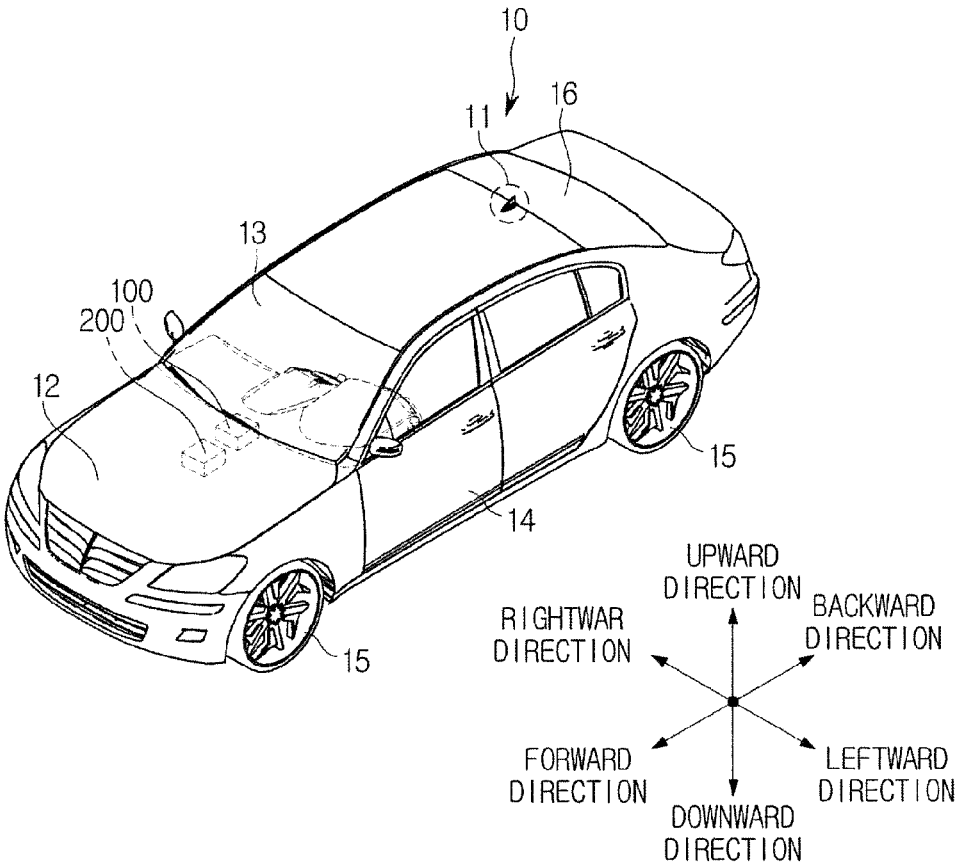
FIG. 14 is a view illustrating an example of a vehicle exterior.
Figure 15:
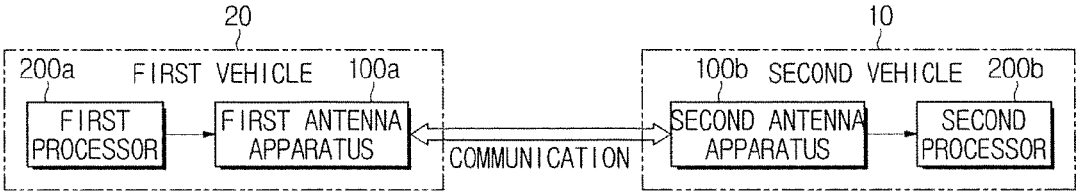
FIG. 15 is a block diagram illustrating a first vehicle and a second vehicle.

FIG. 14 is a view illustrating an example of a vehicle exterior, and FIG. 15 is a block diagram illustrating a first vehicle and a second vehicle.

As illustrated in FIG. 14, a vehicle 10 includes an external frame 12 forming an exterior of the vehicle 10. A wind shield 13 shields wind from flowing into the vehicle 10. Doors 14 are closable so that a driver or a fellow passengers are able to ride in the vehicle 10. At least one wheel 15 moving the vehicle 10 in a predetermined direction is installed at the external frame 12.

In addition, an external antenna 11 capable of receiving an external electromagnetic wave or radiating an electromagnetic wave may be installed at the external frame 12. The external antenna 11 according to one embodiment may be installed on an upper surface of the external frame 12, that is, a frame or a sunroof forming a ceiling of the vehicle 10, and may be installed adjacent to a rear window glass 16.

A processor 200, which controls various operations of the antenna apparatus 100 and the vehicle 10, may be installed inside the external frame of the vehicle 10.

As illustrated in FIG. 15, the processor 200 may output an electrical signal, transmit the electrical signal to the antenna apparatus 100, in addition, the processor 200 may generate a control signal to control the vehicle 10 based on an electrical signal transmitted from the antenna apparatus 100, and transmit the generated control signal to one component in the vehicle 10, for example, a display apparatus for a vehicle.

In addition, the processor 200 may generate a control signal according to a result of communication with another external vehicle (20 in FIG. 15) or an infrastructure (30 in FIG. 17), or transmit various information or control signals to the other external vehicle 20 or the infrastructure 30 by controlling the external antenna 11 or the antenna apparatus 100. The processor 200 may be implemented using at least one of semiconductor chips and related components, and here, the semiconductor chips and related components may be installed on a PCB.

As described above, the antenna apparatus 100 may include the first antenna unit 110, the second antenna unit 120, the distribution unit 130, and substrate 150. The first antenna unit 110 may be inclined in a direction of one boundary of the substrate 150 at the first inclination angle θ1, and the second antenna unit 120 may be inclined at the second inclination angle θ2 in a direction of a boundary opposite to the direction in which the first antenna unit 110 is inclined. The distribution unit 130 may distribute an electrical signal transmitted from a process 100 and transmit the distributed electrical signal to at least one of the first antenna unit 110 and the second antenna unit 120.

The first antenna unit 110 may include the first antenna radiation unit 111, and may further include the first reflection unit 112. Similarly, the second antenna unit 120 may also include the second antenna radiation unit 121, and may further include the second reflection unit 122 according to an embodiment.

As described above, the first inclination angle θ1 and the second inclination angle θ2 are controllable, and the control may be performed by using the rotating shaft member 1123 provided between the supports 113 and 123 and the reflection units 112 and 122, or the rotating shaft member 1503 provided between the supports 113 and 123 and the substrate 150.

The first antenna unit 110 and the second antenna unit 120 may be disposed in alternate directions on the substrate 150, and thus, the first antenna unit 110 and the second antenna unit 120 may be arranged on the substrate 150 in a zig-zag pattern.

The distribution unit 130 may include the first antenna connection portion 131, the second antenna connection portion 132, and the transmission path 133, and the first antenna connection portion 131 and the second antenna connection portion 132 may respectively include the first quarter-wave transformer 131*b* and the second quarter-wave transformer 132*b*. In addition, the transmission path 133 may include the first transmission path 134 connected to two ends, of which one end is one end of the first antenna connection portion 131 and the other end is one end of the second antenna connection portion 132. The second transmission path 135 is connected to the first transmission path 134 and transmits an electrical signal to the first transmission path 134. As described above, the electrical signal transmitted through the second transmission path 135 may be branched when transmitted to the first transmission path 134.

Since additional descriptions about the components of the antenna apparatus 100 have already been described, and thus, the detail descriptions will be omitted hereinafter.

The external antenna 11 installed on an upper surface of the vehicle 10 may also be implemented using the above-described antenna apparatus 100.

Figure 16:
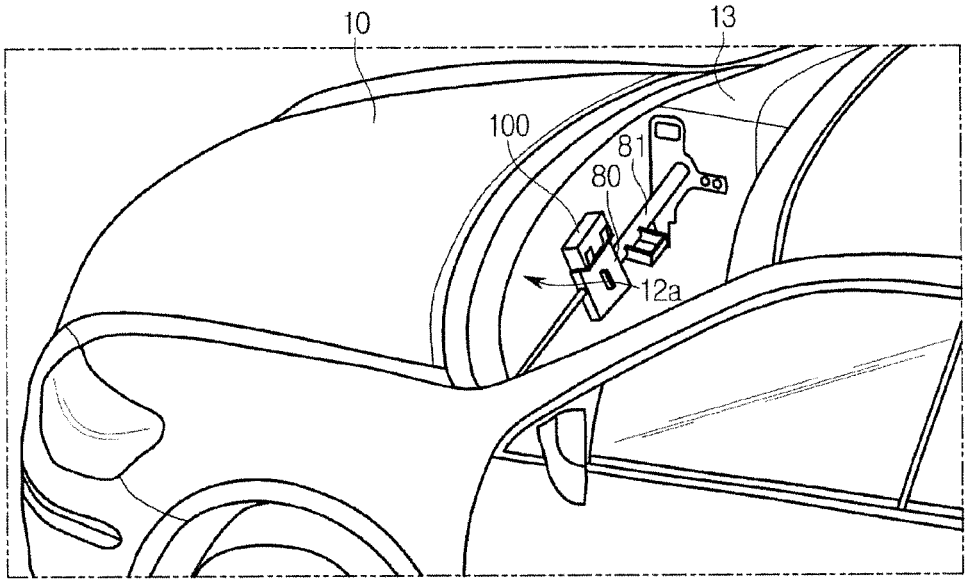
FIG. 16 is a view illustrating an example in which the antenna apparatus is installed in a vehicle.

FIG. 16 is a view illustrating an example in which the antenna apparatus is installed in a vehicle.

As illustrated in FIG. 16, a frame 80 may be installed between an engine room 12*a* and a dashboard (not shown)

of the vehicle 10. The predetermined frame 80 extends from a left side to a right side of the vehicle 10, and a seating portion 81 on which the antenna apparatus 100 is installable is provided at the middle or around the middle of the frame 80. The antenna apparatus 100 may be installed on the seating portion 81. Accordingly, the antenna apparatus 100 may be installed between the engine room 12*a* and the dashboard of the vehicle 10, and thus may radiate an electromagnetic wave in a forward direction of the vehicle 10. An example in which the antenna apparatus 100 is installed between the engine room 12*a* and the dashboard of the vehicle 10 is illustrated in FIG. 16, however, the antenna apparatus 100 may be installed at various positions in addition thereto.

For example, the antenna apparatus 100 may also be installed on the upper surface of the vehicle, and in this case, may be installed adjacent to the rear window glass 16. In addition, the antenna apparatus 100 may also be installed between a rear seat and a trunk of the vehicle 10. In addition thereto, the antenna apparatus 100 may be installed at various positions of the vehicle 10 which may be considered by a designer or a user.

According to one embodiment, a plurality of antenna apparatuses 100 may be installed at the one vehicle 10. In order to radiate electromagnetic wave in both directions which are a forward and a backward directions of the vehicle 10, one antenna apparatus 100 may be provided at a position from which the electromagnetic wave is capable of being radiated in the forward direction of the vehicle 10, for example, between the engine room 12*a* and the dashboard, and the other antenna apparatus 100 may be installed at a position from which the electromagnetic wave is capable of being radiated in the backward direction of the vehicle, for example, around the rear window glass 16.

Figure 17:
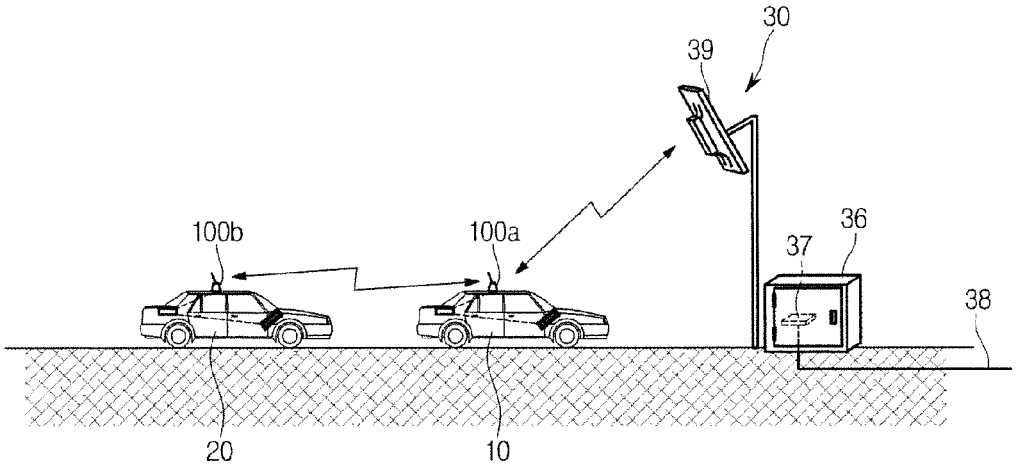
FIG. 17 is a view for describing communication between the first vehicle and the second vehicle, and between the second vehicle and an infrastructure.

FIG. 17 is a view for describing communication between a first vehicle and a second vehicle, and between a second vehicle and an infrastructure.

Specifically, as illustrated in FIGS. 15 and 17, a first vehicle 10 may radiate an electromagnetic wave through an antenna apparatus 100*a* toward the outside. In this case, the antenna apparatus 100*a* may radiate a corresponding electromagnetic wave based on an electrical signal transmitted from a first processor 200*a* provided in the first vehicle 10. A second vehicle 20 may receive the electromagnetic wave radiated through the antenna apparatus 100*a* of the first vehicle 10 through a second antenna apparatus 100*b*. The received electromagnetic wave is demodulated and converted to an electrical signal, and the second processor 200*b* may generate a control signal corresponding to the converted electrical signal, and use the control signal to control the second vehicle 20.

The second antenna apparatus 200*b* of the second vehicle 20 may radiate a corresponding electromagnetic wave based on the transmitted electrical signal based on the control signal transmitted from the second processor 200*b* of the second vehicle 20. Then, the first vehicle 10 may receive the electromagnetic wave radiated from the second antenna apparatus 200*b* of the second vehicle 20, and convert the received electromagnetic wave into an electrical signal, and the first processor 200*a* may generate a control signal according to the electrical signal, and use the control signal for controlling the first vehicle 10. Accordingly, vehicle to vehicle (V2V) communication may be implemented.

In addition, an antenna apparatus 39, which is capable of receiving an electromagnetic wave radiated from the first antenna apparatus 100*a* of the first vehicle 10 or radiating an electromagnetic wave, may also be provided at an infrastructure 30 of a road. According to one embodiment, the antenna apparatus 39 installed at the infrastructure 30 may also include a first antenna unit 110, a second antenna unit 120, a distribution unit 130, and a substrate 150 as described above.

The road infrastructure 30 may receive an electromagnetic wave radiated from the first antenna apparatus 100*a* of the first vehicle 10. An electrical signal corresponding to the received electromagnetic wave may be transmitted to a processor 37 installed in a cabinet 36 provided separately. Here, the processor 37 may be implemented using a computer apparatus or the like. The processor 37 may obtain information or generate a predetermined control signal using the received electrical signal. According to an embodiment, the processor 37 may transmit the electrical signal, the control signal generated according to the electrical signal, or the information obtained based on the electrical signal to a server apparatus of the outside through an additional cable 38 connected to the processor 37.

In addition, the processor 37 in the infrastructure 30 may transmit a predetermined control signal or information to the antenna apparatus 39 of the infrastructure 30, and the antenna apparatus 39 may radiate an electromagnetic wave corresponding to the predetermined control signal or the information. In this case, the first antenna apparatus 100*a* of the first vehicle 10 may receive the electromagnetic wave transmitted from the antenna apparatus 39 of the infrastructure 30, and the first processor 200*a* of the first vehicle 10 may generate a control signal for controlling various components of the first vehicle 10, for example, a display apparatus for a vehicle, based on the electrical signal corresponding to the received electromagnetic wave, and transmit the control signal to the various components of the vehicle 10. Accordingly, vehicle to infrastructure (V2I) communication may be performed.

Figure 18:
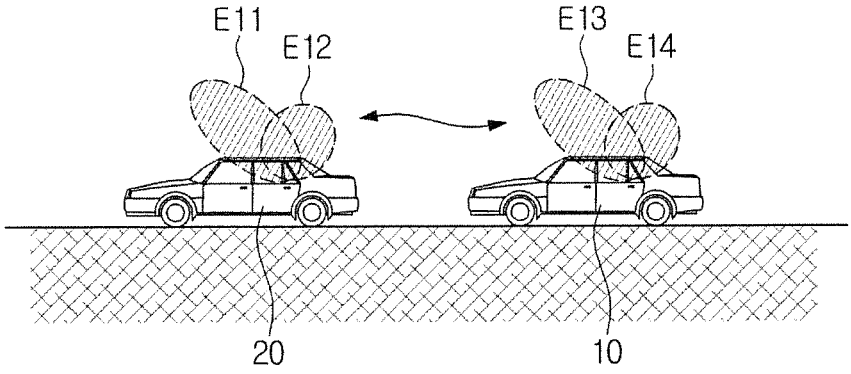
FIG. 18 is a view illustrating radiation shapes of electromagnetic waves of communication between conventional vehicles.
Figure 19:
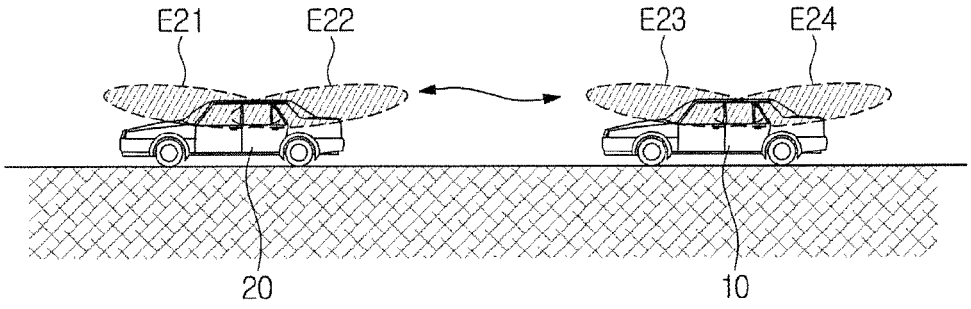
FIG. 19 is a view illustrating radiation shapes of electromagnetic waves between vehicles in which the antenna apparatus are installed.

FIG. 18 is a view illustrating radiation shapes of electromagnetic waves of communication between conventional vehicles, and FIG. 19 is a view illustrating radiation shapes of electromagnetic waves between vehicles in which the antenna apparatus are installed.

When the V2V communication or the V2I communication is performed as described above, communication quality may be changed according to radiation shapes of electromagnetic waves of the antenna apparatus 100.

As illustrated in FIG. 18, since a conventional antenna is a non-directional, the conventional antenna radiates electromagnetic waves E13 to E14 not only in a forward and a backward direction of the first vehicle 10 in which the second vehicle 20 is highly likely to be positioned but also in a upward direction of the first vehicle 10. Thus, an energy loss of the first vehicle 10 occurs, and accordingly, a possible communication range was limited. Since a frequency generally used for communication between the vehicles 10 and 20 is 5. 9 GHz and the magnitude thereof is small, when the antenna is embedded in the vehicle, a signal reduction becomes great due to an effect of dashboards, wind shields, or the frames of the vehicles 10 and 20.

Referring to FIG. 19, when the above-described antenna apparatus 100 is installed, since the electromagnetic waves E21 to E24 may be intensively radiated in a forward and a backward directions of the first vehicle 10 and second vehicle 20, an undesired energy loss may be reduced. In addition, the possible communication range in the forward and the backward directions thereof may be more extended. Since the electromagnetic waves E21 to E24 are more intensively radiated, the signal reduction effect due to the dashboards, the wind shields, or the frames of the vehicles 10 and 20 may be reduced.

The antenna apparatus 100 and the vehicle 10 in which the antenna apparatus 100 is installed have been described above, however, the above-described antenna apparatus 100 is not limited to what is installable in the vehicle 10. The above-described antenna apparatus 100 may also be used for general mobile communication, for example, wireless communication according to third Generation Partnership Project (3GPP), third Generation Partnership Project 2 (3GPP2), or world interoperability for microwave access (WiMAX) based various mobile communication protocols, and may also be used for various wireless communications using other high frequencies. In addition, the above-described antenna apparatus 100 may also be used for implementing various services using the wireless communications described above.

As is apparent from the above description, the antenna apparatus can concentrate radiation energy of the in a desired direction, and minimize a reduction effect due to an external object, and thus, extend a possible communication range and transmits a signal to a desired position.

The antenna apparatus and the vehicle using the antenna apparatus can restrain occurrence of eccentricity of antenna beam due to a metallic frame forming an exterior of the vehicle. In addition, concentrate antenna energy on an external infrastructure when vehicle to vehicle communication is performed or vehicle to infrastructure communication is performed.

The antenna apparatus and the vehicle using the antenna apparatus can extend a possible communication distance between a vehicle and a vehicle or a vehicle and an infrastructure, and prevent communication failures.

In the antenna apparatus and the vehicle using the antenna apparatus can be installed in the vehicle, and an exterior of the vehicle can be more variously designed. In addition, destruction of the antenna apparatus due to an external impact can be prevented.

Although embodiments in the present disclosure have been shown and described, it would be appreciated by those skilled in the art that changes may be made in these embodiments without departing from the principles and spirit of the invention, the scope of which is defined in the claims and their equivalents.

What is claimed is:

1. An antenna apparatus comprising:

a substrate;

a first antenna installed on the substrate relatively adjacent to a first edge of the substrate and inclined in a direction to a second edge of the substrate at a first inclination angle;

a second antenna installed on the substrate relatively adjacent to a third edge of the substrate and inclined in a direction to a fourth edge of the substrate at a second inclination angle, wherein the third edge and the fourth edge are opposite to the first edge and the second edge, respectively;

a first support, which has a pole shape, having one end disposed on the substrate and supporting the first antenna, the first support inclined downwardly toward the second edge of the substrate so that the first antenna is inclined upwardly toward the second edge of the substrate;

a second support, which has a pole shape, disposed on the substrate and supporting the second antenna, the second support inclined downwardly toward the fourth edge of the substrate so that the second antenna is inclined upwardly toward the fourth edge of the substrate; and a distributor distributing an electrical signal to one of the first antenna and the second antenna, wherein the first support and the second support are sequentially disposed in parallel on a line which vertically passes through the first edge and the second edge of the substrate.

2. The antenna apparatus of claim 1, wherein at least one of the first inclination angle and the second inclination angle is adjustable.

3. The antenna apparatus of claim 1, wherein the first antenna is inclined in a direction of one boundary of the substrate and the second antenna is inclined in a direction of another boundary of the substrate.

4. The antenna apparatus of claim 1, wherein the first antenna and the second antenna are disposed in alternate directions on the substrate.

5. The antenna apparatus of claim 1, wherein the first antenna includes:

a first antenna radiator radiating or receiving an electromagnetic wave; and a first reflector having one surface which faces the first antenna radiator and providing directivity to the electromagnetic wave radiated from the first antenna radiator.

6. The antenna apparatus of claim 5, wherein the first support having another end installed on the first reflector.

7. The antenna apparatus of claim 6, further comprising:

a first rotation shaft disposed between the first support and the first reflector, wherein the first reflector rotates by the first rotation shaft member to change the first inclination angle.

8. The antenna apparatus of claim 6, further comprising:

a second rotation shaft member disposed between the first support and the substrate, wherein the support rotates by the second rotation shaft to change the first inclination angle.

9. The antenna apparatus of claim 5, wherein the first antenna further includes a first antenna radiator feeder transmitting the electrical signal to the first antenna radiator.

10. The antenna apparatus of claim 1, wherein the distributor includes:

a first antenna connector electrically connected to the first antenna; and a second antenna connector electrically connected to the second antenna.

11. The antenna apparatus of claim 10, wherein the first antenna connector includes:

a first antenna connector end; and a first quarter-wave transformer ($\lambda/4$) electrically connected to the first antenna connector end.

12. The antenna apparatus of claim 10, wherein the distributor includes a transmission path transmitting the electrical signal to the first antenna connector and the second antenna connector.

13. The antenna apparatus of claim 12, wherein the transmission path includes:

a first transmission path connected to one end of the first antenna connector and one end of the second antenna connector; and a second transmission path, which intersects and is connected to the first transmission path, transmitting the electrical signal to the first transmission path, wherein the electrical signal transmitted through the second transmission path is branched when transmitted to the first transmission path.

14. The antenna apparatus of claim 13, further comprising:

an external transmission cable electrically connected to the second transmission path.

15. A vehicle comprising:

a processor configured to output an electrical signal or generating a control signal based on the electrical signal transmitted from outside; and an antenna apparatus converting the first electrical signal output from the processor to an electromagnetic wave and radiating the electromagnetic wave, wherein the antenna apparatus includes:

a substrate;

a first antenna installed on the substrate relatively adjacent to a first edge of the substrate and inclined in a direction to a second edge of the substrate at a first inclination angle;

a second antenna installed on the substrate relatively adjacent to a third edge of the substrate and inclined in a direction to a fourth edge of the substrate at a second inclination angle, wherein the third edge and the fourth edge are opposite to the first edge and the second edge, respectively;

a first support, which has a pole shape, having one end disposed on the substrate and supporting the first antenna, the first support inclined downwardly toward the second edge of the substrate so that the first antenna is inclined upwardly toward the second edge of the substrate;

a second support, which has a pole shape, disposed on the substrate and supporting the second antenna, the second support inclined downwardly toward the fourth edge of the substrate so that the second antenna is inclined upwardly toward the fourth edge of the substrate; and a distributor distributing the electrical signal to one of the first antenna and the second antenna, wherein the first support and the second support are sequentially disposed in parallel on a line which vertically passes through the first edge and the second edge of the substrate.

16. The vehicle of claim 15, wherein at least one of the first inclination angle and the second inclination angle is adjustable.

17. The vehicle of claim 15, wherein the first antenna and the second antenna are disposed in alternate directions on the substrate.

18. The vehicle of claim 15, wherein the first antenna includes:

a first antenna radiator radiating or receiving the electromagnetic wave; and a first reflector having one surface which faces the first antenna radiator and providing directivity to the electromagnetic wave radiated from the first antenna radiator.

19. The vehicle of claim 15, wherein the distributor includes:

a first antenna connector electrically connected to the first antenna; and a second antenna connector electrically connected to the second antenna.

20. The vehicle of claim 19, wherein the first antenna connector includes:

a first antenna connector end; and a first quarter-wave transformer ($\lambda/4$) electrically connected to the first antenna connector end.

21. The vehicle of claim 19, wherein the distributor includes a transmission path transmitting the electrical signal to the first antenna connector and the second antenna connector.

22. The vehicle of claim 21, wherein the transmission path includes:

a first transmission path connected to one end of the first antenna connector and one end of the second antenna connector; and a second transmission path, which intersects and is connected to the first transmission path, transmitting the electrical signal to the first transmission path, wherein the electrical signal transmitted through the second transmission path is branched when transmitted to the first transmission path.

23. The vehicle of claim 15, wherein the antenna apparatus is installed between an engine room and a dashboard of the vehicle.

24. A The vehicle of claim 15, wherein the antenna apparatus converts the electromagnetic wave, which is transmitted from the outside, to the electrical signal and transmits the electrical signal to the processor.

* * * * *